United States Patent [19]

Artzt et al.

[11] 3,956,876

[45] May 18, 1976

[54] APPARATUS FOR SUPPLYING ORIENTED FIBERS TO A SPINNING ROTOR INNER WALL IN AN OPEN-END SPINNING DEVICE

[75] Inventors: Peter Artzt, Reutlingen; Albert Bausch, Melchingen; Gerhard Egbers, Eningen, all of Germany

[73] Assignee: Schubert & Salzer Maschinenfabrik Aktiengesellschaft, Ingolstadt, Germany

[22] Filed: Dec. 16, 1974

[21] Appl. No.: 533,140

[30] Foreign Application Priority Data

Dec. 22, 1973 Germany ..... 2364261

[52] U.S. Cl. ..... 57/58.95

[51] Int. Cl.[2] ..... D01H 1/12

[58] Field of Search ..... 57/58.89–58.95

[56] References Cited

UNITED STATES PATENTS

| | | | |
|---|---|---|---|
| 3,511,042 | 5/1970 | Anna-Seidov et al. | 57/58.89 |
| 3,672,144 | 6/1972 | Didek et al. | 57/58.95 |
| 3,834,145 | 9/1974 | Ellingham et al. | 57/58.95 X |
| 3,861,132 | 1/1975 | Stahlecker et al. | 57/58.89 |

*Primary Examiner*—Richard C. Queisser
*Assistant Examiner*—Charles Gorenstein
*Attorney, Agent, or Firm*—Robert W. Beach; R. M. Van Winkle

[57] ABSTRACT

Fibers are carried to a spinning rotor from a fiber-resolving device by a translational fluid medium, such as air, which is first accelerated to orient the fibers. Carrier fluid next is maintained at constant speed and laminar flow to deliver the oriented fibers to a rotating laminar fluid in the region adjacent to the inner wall of the spinning rotor. The acceleration and velocity of the translational fluid is effected by a feed tube having a frustoconical infeed section, tapered toward a cylindrical outfeed section.

3 Claims, 5 Drawing Figures

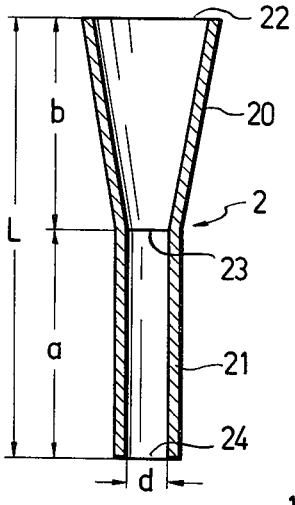
Fig.2
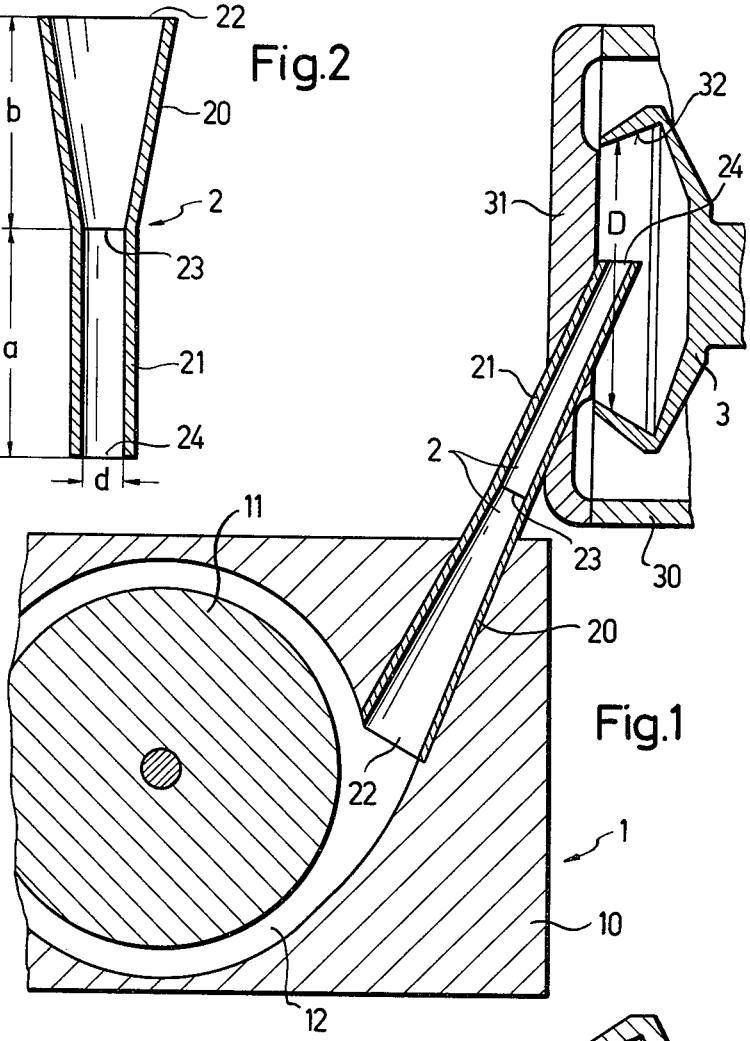
Fig.1
Fig.4
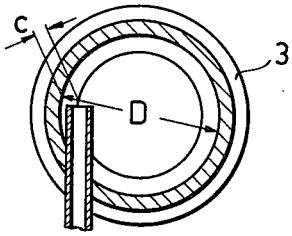
Fig.3
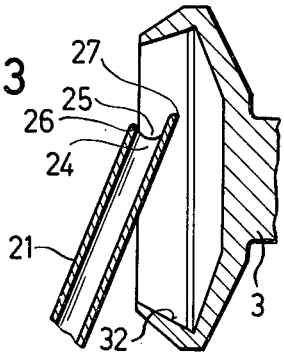
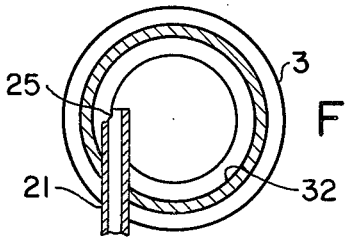
Fig. 5

APPARATUS FOR SUPPLYING ORIENTED FIBERS TO A SPINNING ROTOR INNER WALL IN AN OPEN-END SPINNING DEVICE

The present invention relates to a method and apparatus for supplying fibers to the inner wall of a spinning rotor of an open-end spinning machine whereby fibers resolved from a sliver are oriented and transported by an air current.

BACKGROUND OF THE INVENTION

1. Field of the Invention

It is important to stretch fibers resolved from a sliver and to orient and maintain the stretched fibers in parallelized condition as they are transported from a resolving device to a fiber collection surface of a spinning rotor. The most effective means of transporting such fibers utilized heretofore has been by an accelerated air stream passing through a fiber feed tube extending from the resolving device to the fiber-collection surface. However, intermolecular friction and friction between the air and the walls of the feed channel through which the air flows create shear stress in the air stream which results in turbulence. Consequently, fibers are frequently improperly and randomly oriented when they reach the spinning rotor, so that the quality and consistency of yarn spun in the rotor has suffered.

On the other hand, in the region in which the air stream contacts the rigid walls of a feed tube, the molecular random or mixing motion is damped by friction with the tube walls so that a boundary layer of laminar flow results. However, at locations spaced from the tube walls, the damping effect of the wall decreases and the internal friction of the air molecules again creates conditions such that turbulence is predominant. Again, fibers carried by the air stream are effected by such turbulence so that they cannot be maintained in a desired consistently oriented, generally parallel condition.

2. Prior Art

A variety of feed tubes for transporting fibers from one location to another are known. The following prior art is the most relevant to the present invention. The prior art disclosures do not recognize or solve the turbulence problems overcome by the present invention; and feed tubes constructed in accordance with those disclosures do produce turbulent airflow conditions, or are not suitable for parallelizing fibers, or otherwise are incapable of orienting fibers satisfactorily to cooperate with an open-end spinning machine for forming yarn of consistent quality and desired characteristics.

Prior apparatus for accelerating an air current for transporting fiber is disclosed in DT-AS 1,510,741 which includes a frustoconical or otherwise reduced cross-sectional area feed tube. While the fibers being transported to the spinning rotor may be oriented as desired initially, the aforesaid conditions of turbulence prevail and prevent controlled orientation of the fibers at the point of deposit on the fiber collection surface of a spinning rotor.

Prior feed tubes having a conic portion followed by a cylindrical portion have been proposed. One such feed tube arrangement is disclosed in DT-OS 1,922,743. In this case, the conic portion functions as a condenser. The cylindrical portion merely forms a passage through the spinning rotor housing cover and cooperates with the conic portion to hold the cover firmly in place. Another feed tube is shown in DT-OS 1,925,999, but the degree of conicity of the conic portion is too slight to impart sufficient acceleration to the fibers for effecting a consistent fiber lay. The fibers are accelerated by an auxiliary vacuum air current which acts on the fibers in the region between the conic and cylindrical portion. The effect of this sudden air current is to create substantial turbulence whereby the lay of the fibers is undesirably disturbed.

Another variation in feed tubes is disclosed in U.S. Pat. No. 3,521,440 in which the cross-sectional shape of a tube is varied along its length without changing the cross-sectional area of the tube. This type of tube serves the function of urging fibers together to form a concentrated fiber stream and is used for fibers delivered by a drafting system rolling mill. In this apparatus, there is no acceleration of the air which accompanies the fiber stream.

SUMMARY OF THE INVENTION

It is the principal object of the present invention to provide a method and apparatus which produces acceleration of the proper degree of transport and orientation of resolved fibers by a fluid or air medium.

It is a companion object to eliminate the turbulence which has heretofore prevented deposition of fibers on the spinning rotor inner wall with consistent preferred orientation.

The foregoing objects are accomplished in accordance with the present invention by first subjecting fibers resolved from a sliver to a rapidly accelerating air current, by immediately thereafter subjecting such fibers to an air current flowing at substantially constant velocity and, finally, by subjecting such fibers to the rotational forces of the rotating inner wall of the spinning rotor. The intermolecular friction of the fluid medium is reduced and turbulence is substantially diminished by the sequential process of accelerating the fluid current and then maintaining such current at a velocity approaching constancy. By such method the fibers supplied to such current are also stabilized so that the fibers are transported in stretched and parallelized condition to the spinning rotor inner wall.

Apparatus for carrying out this procedure includes a feed tube having a frustoconical first section tapering to a cylindrical second section. The infeed orifice of the conic portion has a cross-sectional area 4 to 20 times the area of the cylindrical portion. The diameter of the cylindrical portion is between one-tenth and one-twenty-fifth of the total length of the feed tube, and the length of the cylindrical portion is from ½ to 3 times the length of the conic portion. In a feed tube constructed within these proportions, a stream of air passing through the tube first strongly accelerates the fibers delivered by a sliver-opening roller. Because of their mass, the fibers have sufficient inertia so that they cannot be accelerated as quickly as the air. Consequently, the conic portion must have sufficient length and conicity to provide an adequate period to accelerate the fibers to the velocity of the air stream in the cylindrical portion of the feed tube. The internal friction of the air is substantially reduced in the tube cylindrical portion so that there is little turbulence in this portion of the fiber transport. Consequently, the lay of the fibers is improved and stabilized.

In order to prevent a source of turbulence at the outfeed orifice of the feed tube, the center of the orifice should be spaced from the spinning rotor inner wall a distance between one-tenth and four-tenths of the inside diameter of the spinning rotor at the location of the outfeed end of the feed tube. The fiber can be guided even more advantageously from the substantially constant velocity of the feed tube into the angular velocity of the spinning rotor boundary layer by providing a notch in the outfeed end of the feed tube adjacent to the rotor inner wall, the length of which notch extends in the circumferential direction of the spinning rotor.

BRIEF DESCRIPTION OF DRAWINGS

FIG. 1 is a section through a resolving device and spinning rotor taken axially of the rotor and showing the fiber feed arrangement of the present invention.

FIG. 2 is an axial section through a feed tube in accordance with the present invention.

FIG. 3 is a fragmentary section similar to FIG. 1 showing a modified feed tube.

FIG. 4 is a diametral section through the spinning rotor showing the outfeed end of the feed tube with parts broken away.

FIG. 5 is a diametral section similar to FIG. 4, but showing the modified feed tube of FIG. 3.

DETAILED DESCRIPTION

The open-end spinning device shown in FIG. 1 conventionally includes a resolving device 1 for resolving a fiber sliver into individual fibers. Such fibers are transported by a feed tube 2 to the spinning rotor 3. Spinning rotor 3 is enclosed by a housing 30 closed by a cover 31. The cover also carries a draw-off tube (not shown) through which spun thread is drawn off by a conventional take-up device. The subpressure required for spinning is created either by the rotation of the spinning rotor itself or by evacuating means common to a number of spinning rotors. The form of resolving device shown by way of illustration includes a rapidly rotating opening roller 11 carried in a housing 10. The roller-receiving hollow of housing 10 forms with the roller periphery a channel 12 for guiding the fibers to feed tube 2. The feed tube has a frustoconical infeed section 20 which is joined at 23 directly to a cylindrical outfeed section 21. The larger end of the conical section defines an infeed orifice 22 and the end of the cylindrical section remote from the conical section defines an outfeed orifice 24. A fluid medium, which is preferably air, transports the fibers through feed tube 2.

In accordance with the present invention, the conical section is to effect acceleration of the air to the desired end velocity, for which purpose a very rapid acceleration is required. The degree of acceleration between the resolving device 1 and the feed tube junction 23 should be in the range of $6.6 \times 10^5$ cm/sec. and $1.8 \times 10^6$ cm/sec$^2$ and the degree of acceleration between the junction 23 and the outfeed orifice 24 should be in the range of $2 \times 10^6$ cm/sec$^2$ and $7.8 \times 10^5$ cm/sec$^2$. In order to produce the necessary acceleration, the infeed orifice 22 has a cross-sectional area four to twenty times greater than the cross-sectional area of the tubular passage through the cylindrical section 21. The cross-sectional area of the cylindrical section is established in the conventional manner. In the cylindrical section 21, the air assumes a constant velocity.

While fibers carried by the feed tube air stream are accelerated by frictional engagement with the air stream molecules, such fibers receive a somewhat smaller acceleration than the air stream acceleration resulting from the taper of the passage through the conic section because of their inertia. The fiber speed, therefore, is less than the air speed at the junction 23 between the conic section 20 and the cylindrical section 21. Because of intermolecular friction in the accelerating air stream, turbulence is created which disturbs the parallelized lay of the fibers which would result from streamline air flow. Consequently, in order to postaccelerate the fibers to improve the lay of the fibers in the rotor 3 in accordance with the present invention, the cylindrical section 21 is joined directly to the smaller end of the frustoconical section 20. As the air assumes constant velocity in the cylindrical section, intermolecular friction is reduced, and, consequently, there is little turbulence in this feed tube portion. Because the fibers do not achieve the same speed as the air stream in the conic accelerating section 20, the fibers are additionally accelerated in the constant air speed cylindrical section whereby they are further straightened and parallelized, and such orientation is maintained by the substantially turbulent-free air stream throughout the cylindrical section.

It has been determined in accordance with the invention that the length *a* of the cylindrical section 21 shown in FIG. 2 must be between one-half and three times the length *b* of the conic section 20. Experiments have shown that the fibers cannot be postaccelerated to attain substantially the speed of the air in the cylindrical section if it is shorter than one-half the length of the conic section. Furthermore, it has been determined that, if the cylindrical section is longer than three times the length of the conic section, the effect of the friction between the tube walls and the air predominates and generates turbulence in the air stream.

The total length L of the feed tube 2 has been determined in accordance with the present invention to be in the range of ten to twenty-five times the internal diameter *d* of the cylindrical section 21. Within this range the fibers can be accelerated to the desired end speed while permitting good parallelization of the fibers and stabilization of the fiber lay to be achieved in the cylindrical section 21. A typical exemple of a preferred type of feed tube for spinning of short staple fibers has the following dimensions:

Length *a* of the cylindrical section 21 : 40 mm
Length *b* of the conic section 20 : 40 mm
Total length L : 80 mm
Area of infeed orifice 22 : 154 mm$^2$
Area of junction 23 : 33 mm$^2$ After resolution of a fiber sliver, the individual fibers are first exposed to the effect of a heavily accelerated air stream in the conic section 20 of the feed tube 2. Immediately thereafter the fibers are subjected to an air stream flowing at substantially constant speed through the cylindrical section 21. As the fibers leave the outfeed orifice 24, they are subjected to the effect of the rotating inner wall 32 of the spinning chamber in rotor 33 and the rotating air boundary layer, the speed of which boundary layer corresponds directly, or very closely, to the circumferential speed of the spinning rotor inner wall 32. The angular velocity of the rotating air in the spinning rotor 3 decreases radially inwardly from the rotor wall 32 because, on the one hand, the radius decreases and, on the other hand, because the frictional effect of the boundary layer decreases.

If the feed tube opens into a region in which the rotating boundary layer effects an air speed greater than the speed of the air discharged from the feed tube 2, then an air shear corner develops at the outfeed end of the feed tube and air vortices are created. Such vortices work into the end of the feed tube and cause the exiting fibers to whirl around at the outfeed orifice 24. In order to avoid this vortex effect, it has been determined that the radial distance *c* from the rotor inner wall 32 to the center of the outfeed orifice 24 (FIG. 4) should be in the range of one-fortieth to one-tenth of the diameter D of the rotor diametral plane on which the orifice center lies. By such location of the feed tube outfeed orifice 24 the rotating air flow is not disturbed.

Diametrically opposite sides of the outfeed end of tube 21 along a diameter substantially aligned with the axis of the spinning rotor 3 can be disposed closer to the spinning rotor inner wall 32 in order to maintain the fibers under control of the linear flow of the feed tube air stream for a greater distance along the rotor inner wall 32 axially of the rotor. This can be done in accordance with the present invention by providing a notch 25 in that side of the rim of orifice 24 adjacent to the spinning rotor wall 32. The length of such notch extends in a direction substantially circumferentially of the spinning rotor 3. Therefore, as shown in FIG. 3, the outfeed end of the feed tube 2, has projections 26 and 27 on opposite sides of notch 25 which are located at opposite ends of a chord of orifice 24 extending substantially parallel to the axis of spinning rotor 3. Such a notched feed tube end can be used to improve the performance of other forms of feed tubes used in combination with spinning rotors of openend spinning machines and is not restricted only to use with the feed tube construction disclosed herein.

By use of the method and apparatus of the present invention, fibers are guided in their path from the resolving device 1 under the control of the air current in such a manner that they are deposited in stretched and parallelized condition onto the spinning rotor inner wall 32. At the same time the apparatus for providing such controlled fiber transport is simple in construction. The form of cover 31 is not significant for purposes of the present invention; thus the invention can be used in spinning devices in which the cover projects farther into the spinning rotor cavity than is shown in FIG. 1, and the outfeed end of tube 2 can be just inside the cover, as shown, or can project farther into the rotor cavity.

We claim:

1. Fiber feed apparatus for an open-end spinning device including a spinning rotor having a subpressure within it and a feed tube directed toward and substantially tangentially of the spinning rotor inner wall and having a frustoconical first section including an infeed orifice at the larger section end and a cylindrical second section joined directly to the smaller end of the first section, the second section having an outfeed orifice at its end remote from the first section, the improvement comprising the infeed orifice of the first section having a diameter in the range of 4 to 20 times as great as the diameter of the second section, the second section having a diameter in the range of one-tenth to one-twenty-fifth of the composite length of the first and second sections, and the second section having a length in the range of one-half to three times the length of the first section.

2. The fiber feed apparatus defined in claim 1, in which the center of the second section outfeed orifice is spaced a distance from the spinning rotor inner wall in the range of one-tenth to four-tenths of the inside diameter of the spinning rotor diametral plane on which the outfeed orifice center lies.

3. The fiber feed apparatus for an open-end spinning device including a spinning rotor having a subpressure within it and a feed tube directed toward and substantially tangentially of the spinning rotor inner wall, and having a frustoconical first section and a cylindrical second section joined directly to the smaller end of the first section, the second section having an outfeed orifice at its end remote from the first section, the improvement comprising an elongated notch in the side of the second section adjacent to the rotor inner wall opening at the outfeed orifice and having its length extending substantially circumferentially of the spinning rotor.

* * * * *

UNITED STATES PATENT OFFICE

CERTIFICATE OF CORRECTION

Patent No. 3,956,876 Dated May 18, 1976

Inventor(s) Peter Artzt, Albert Bausch and Gerhard Egbers

It is certified that error appears in the above-identified patent and that said Letters Patent are hereby corrected as shown below:

Column 6, line 17, cancel "diameter" and insert --cross-sectional area--; line 18, cancel "diameter" and insert --cross-sectional area--.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*